US005940927A

United States Patent [19]

Haegermarck et al.

[11] Patent Number: 5,940,927

[45] Date of Patent: Aug. 24, 1999

[54] AUTONOMOUS SURFACE CLEANING APPARATUS

[75] Inventors: Anders Haegermarck, Trångsund; Björn Riise, Sollentuna; Jarl Hulden, Solna, all of Sweden

[73] Assignee: Aktiebolaget Electrolux, Stockholm, Sweden

[21] Appl. No.: 08/981,615

[22] PCT Filed: Apr. 29, 1997

[86] PCT No.: PCT/SE97/00727

§ 371 Date: Dec. 23, 1997

§ 102(e) Date: Dec. 23, 1997

[87] PCT Pub. No.: WO97/40734

PCT Pub. Date: Nov. 6, 1997

[30] Foreign Application Priority Data

Apr. 30, 1996 [SE] Sweden ..... 9601658

[51] Int. Cl.[6] ..... A47L 5/00

[52] U.S. Cl. ..... 15/319; 15/339; 15/340.3

[58] Field of Search ..... 15/319, 339, 340.1, 15/340.3

[56] References Cited

U.S. PATENT DOCUMENTS

| | | | |
|---|---|---|---|
| 4,457,042 | 7/1984 | Jones et al. | 15/332 |
| 4,977,640 | 12/1990 | Hirano et al. | 15/339 |
| 5,109,566 | 5/1992 | Kobayashi et al. . | |
| 5,189,757 | 3/1993 | Williams et al. | 15/332 |
| 5,341,540 | 8/1994 | Soupert et al. . | |

FOREIGN PATENT DOCUMENTS

| | | |
|---|---|---|
| 0351801 A2 | 1/1990 | European Pat. Off. . |
| WO 81/02830 | 10/1981 | WIPO . |
| WO 95/26512 | 10/1995 | WIPO . |

*Primary Examiner*—Robert Warden
*Assistant Examiner*—Kaj Olsen
*Attorney, Agent, or Firm*—Pearne, Gordon, McCoy & Granger LLP

[57] ABSTRACT

An autonomous device is adapted to automatically move on a work surface removing dirt, such as gravel, sand, dust particles and the like, from said work surface. The device comprises a chassis provided with wheels and with a brush roller rotated by a drive motor during said movement for the purpose of brushing up the dirt towards a suction duct wherefrom, by means of a suction air stream, the dirt is conveyed to a dust container. An electronic control device is provided for the control of the drive motor of the brush roller. If the movement of the brush roller is blocked or obstructed to a predetermined extent the control device is arranged to stop the brush roller motor and then transitorily activate the motor in the opposite direction and, finally, after another stop, to reconnect the brush roller motor to operate in the original direction of rotation.

8 Claims, 3 Drawing Sheets

AUTONOMOUS SURFACE CLEANING APPARATUS

BACKGROUND OF THE INVENTION

The present invention relates to an autonomous device of the kind which is arranged to automatically move on a work surface, such as a floor, removing dirt, such as gravel, sand, dust particles and the like, from said work surface. More specifically, the invention relates to such autonomous device which comprises a chassis provided with wheels and with a brush roller rotated by a drive motor during said movement for the purpose of brushing up the dirt towards a suction duct wherefrom, by means of a suction air stream, the dirt is conveyed to a dust container. The device also includes an electronic control device for controlling the drive motor of the brush roller.

An autonomous device as described above is often referred to as vacuum cleaner robot due to the fact that the device can automatically move around on a work surface, according to a predetermined pattern or by random changes of the direction of movement, cleaning the surface from loose dirt, such as gravel, sand, threads, hair and small particle dust. Most often, the autonomous device is battery-driven which means that it cannot have the same capacity as a common vacuum cleaner powered from the mains. Basically, a vacuum cleaner robot comprises a chassis with wheels for the movement and often one or more additional support wheels which are not driven. For the drive of the drive wheels often a separate motor is provided for each drive wheel. In addition, there is provided a unit for the collection of dust comprising a suction nozzle, a suction fan with drive motor and a dust container as well as connection conduits therebetween. Finally, an electronic control device is provided for the coordination of all activities of the vacuum cleaner robot and for the determination of patterns of movement. In addition, the control device is used for the determination of possible obstacles in the near surroundings of the vacuum cleaner robot so that a collision with obstacles is avoided and so that the robot can free itself if getting stuck in a corner or the like.

As a result of the limited suction capacity, suitably, a brush roller is provided which rotates during the movement of the device around the work surface brushing up dust particles towards a suction duct where the suction force takes over conveying the dust to the dust container. A suction force of any greater magnitude is not required at the work surface and the cleaning ability becomes reasonably good due to the joint action of the brush and the suction fan.

However, the rotating brush roller can give a problem when the surface consists of soft carpets provided with fringes. Upon movement of the device in over such a carpet the fringes can be brought with the brush to wind up on the roller and, in the worst case, to get stuck on the brush or between said brush and the adjacent brush roller housing. This can cause a problem with destroyed carpet fringes or cause damage to the brush roller or the accompanying drive motor.

SUMMARY OF THE INVENTION

The object of the invention is to eliminate the drawbacks indicated above and to provide an autonomous device which senses tendencies for carpet fringes or the like to get stuck in the rotating brush thereby controlling the device in such a way that a fringe in the process of getting stuck will be released. The object is solved in an autonomous device of the kind referred to by way of introduction which has obtained the characterizing features indicated in claim 1.

BRIEF DESCRIPTION OF DRAWINGS

The invention will now be described more in detail in connection with an embodiment and with reference to the accompanying drawings, in which.

DETAILED DESCRIPTION OF THE INVENTION

Figure 1:
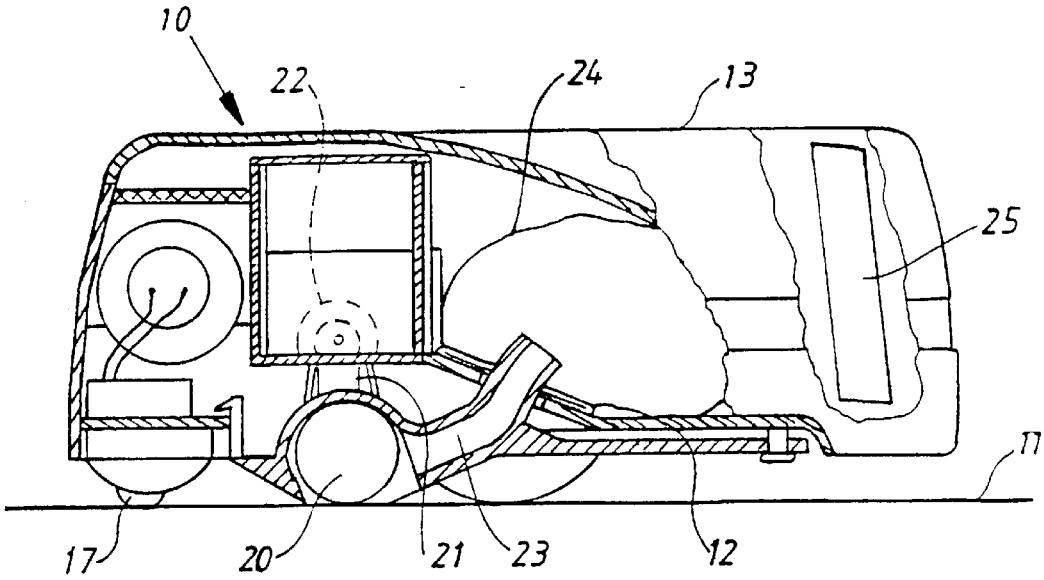
FIG. 1 shows an autonomous device according to the invention in a lateral view, partly in section.
Figure 2:
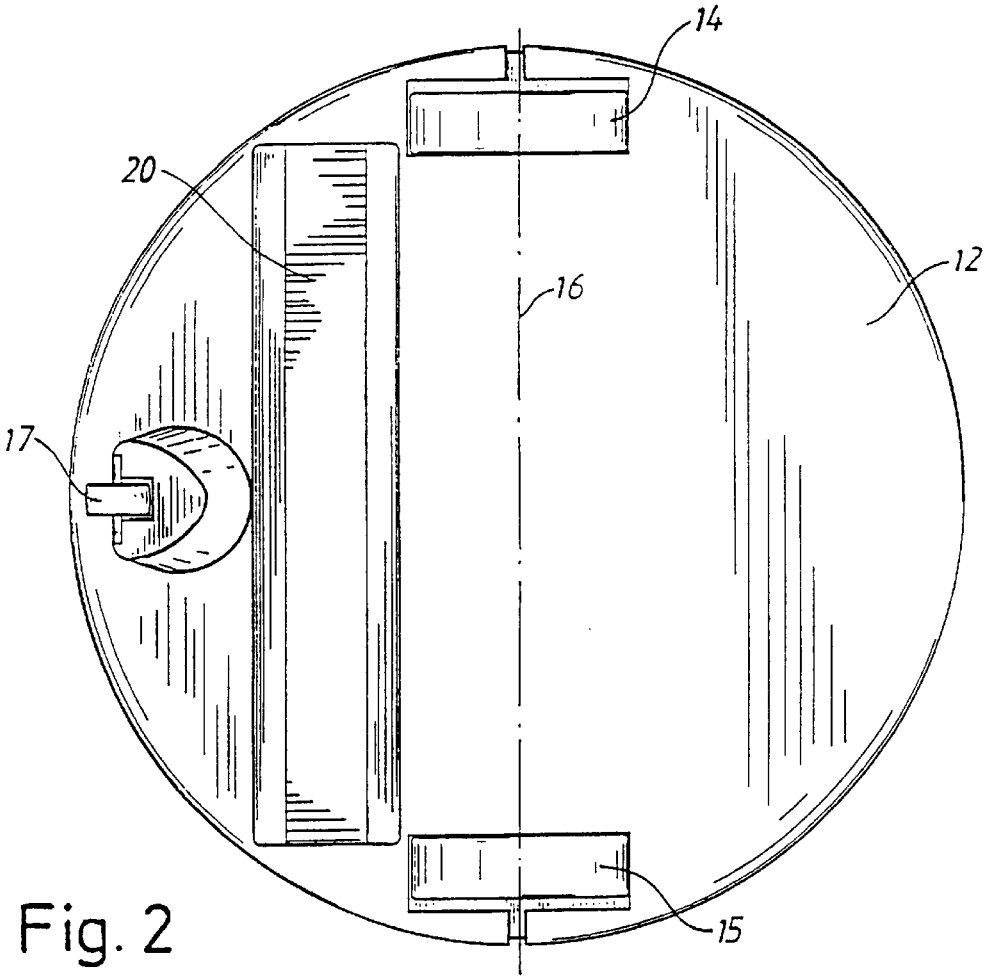
FIG. 2 shows the device of FIG. 1 in a bottom view.

In FIG. 1 there is shown, in a lateral view partly in section, an autonomous device 10 arranged to automatically move on a floor 11 carrying out vaccuming of the same. The device comprises a chassis 12 on which functional units are mounted. The chassis 12 is covered by a cover 13 secured to the chassis by screws or the like, not shown. The device has the shape of a cylinder can and two drive wheels 14, 15 are rotatably journalled on the chassis 12 such that their axis of rotation coincide with a line 16 through the center of the can. In addition to the drive wheels 14, 15 a third wheel 17 is provided designed as a pivot wheel. The driving of the drive wheels is performed by means of separate drive motors, not shown. One advantage with this arrangement is that by driving the drive wheels in opposite directions turning of the device around its center is easily brought about.

The autonomous device comprises a work unit arranged to carrying out vacuuming of the base on which the device is moving. The work unit comprises a rotating brush roller 20 driven by a drive motor 22 via a belt transmission, schematically designated by 21. Suitably, the drive motor 22 is a DC motor for low voltage, for example 12 volts. Adjacent to the brush roller 20, at a distance from the base, a suction duct 23 opens which connects to a dust container 24.

When the brush roller is rotated it will brush up dust from the base to the entrance of the suction duct 23 where the dust is caught by a suction air stream prevailing at the entrance and generated by a suction fan unit, not shown. The brush roller is rotated in a direction opposite to that of the drive wheels 14, 15 during movement in the forward direction (to the right in FIG. 1). This means that the brush roller rotates against the direction of movement of the device. In this way the brush roller will brush the dust in a forward direction which means that dust not immediately caught by the air suction stream will again by the brush roller be brushed up towards the entrance 23 to then be caught by the air suction stream.

For the control and coordination of all activities of the autonomous device there is provided an electronic control device 25. The device comprises a microprocessor of the type MC68332 mounted on a printed circuit board along with memory circuits needed as well as drive circuits for the various drive motors for the drive wheels 14, 15, the brush roller 20 and the suction fan unit. The printed circuit board is constructed in a conventional way and will not be discussed in any further detail.

Figure 4:
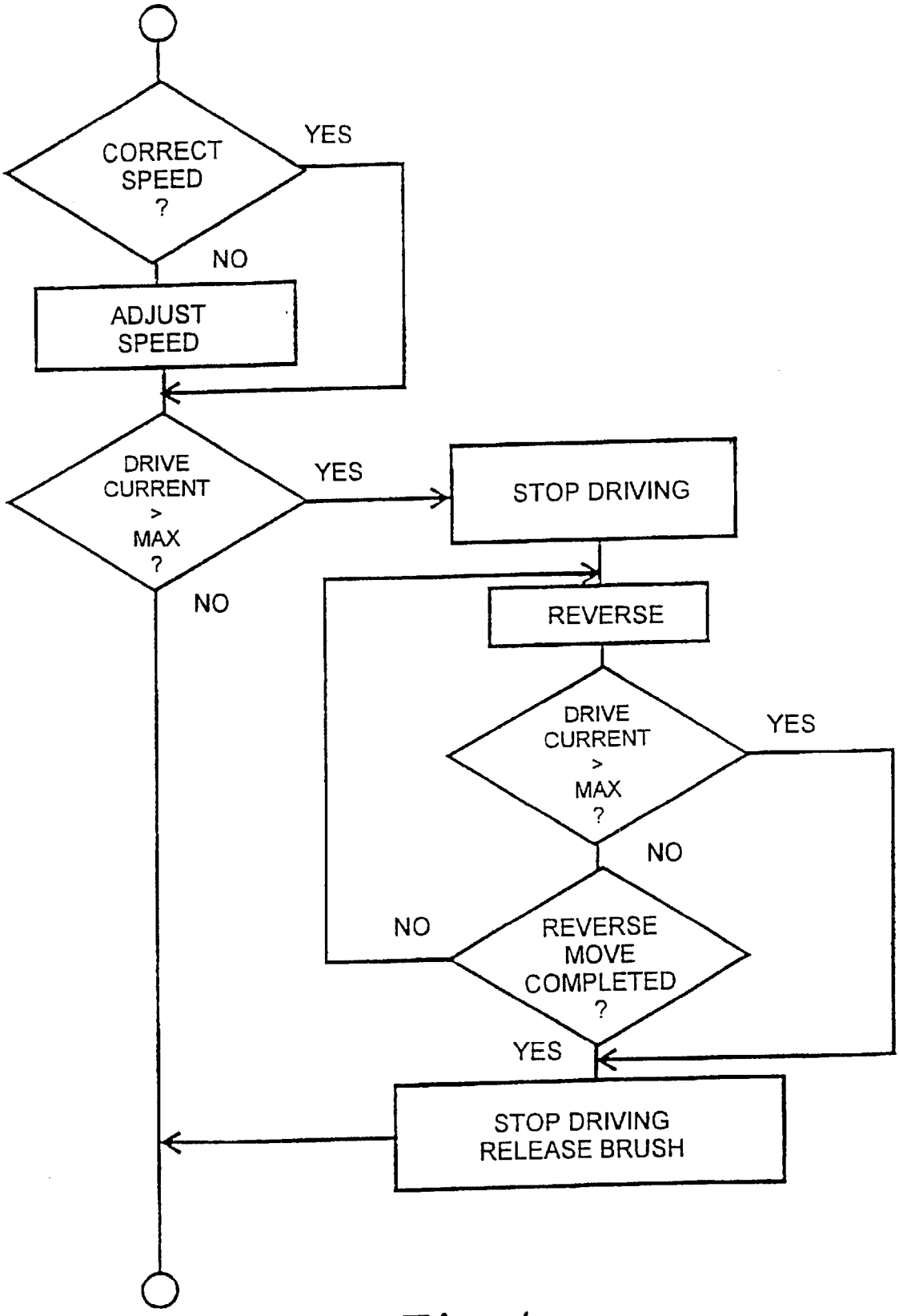
FIG. 4 shows a flow chart illustrating the control of the brush roller motor.

The problem for the invention to solve is connected with the driving of the brush roller and the object is to see to it that if the movement of the brush roller is completely blocked or considerably obstructed this condition is removed. During vacuuming the autonomous device is moving across a floor in randomly chosen directions for so long as to have every part surface of the floor being passed at least once. The floor comprises free surfaces with a hard floor coating as well as surfaces covered by soft carpets. During the movement across the floor the brush roller 20 is rotated at a speed considerably greater than the speed of the drive wheels 14, 15. When the device reaches a carpet fringe it may happen that one or several fringes get caught by the bristles on the roller to follow in the rotating movement. In this way the carpet fringe can be fed into the interior of the device bringing with it the end of the carpet causing the device to get stuck. Therefore, a program sequence has been put into the program memory of the control device with the meaning that if there is an indication of the brush roller getting stuck the brush roller motor is disconnected whereafter the motor is again transitorily switched on but in the opposite direction making it possible for the carpet fringe to be fed out. When the back drive has been completed the brush roller motor is again stopped and thereafter the drive is reconnected with the original direction of rotation. In the normal case this would be sufficient for the release of the brush roller and reestablishment of the function. Should this not be the case the procedure will be repeated. It is also possible that after several reversing procedures without result the device is permanently inactivated to be reactivated only by manual action. This control function is illustrated in the flow chart of FIG. 4 which also includes a part relating the the sensing and correcting of speed. As appears from the flow chart, firstly, the drive current of the brush roller motor is sensed and compared with a limit value. If the limit is exceeded the driving of the brush roller motor is stopped and then the motor is driven in the opposite direction. Thereafter, the drive current is again measured and if the limit is still exceeded the driving is stopped so that the brush roller is principally released. If after the backing procedure the limit is not exceeded it is determined if the predetermined backing movement is fully completed. If so, the driving is stopped and the brush roller released. If the backing movement has not been completed the backing sequence is repeated until backing has been fully completed.

Figure 3:
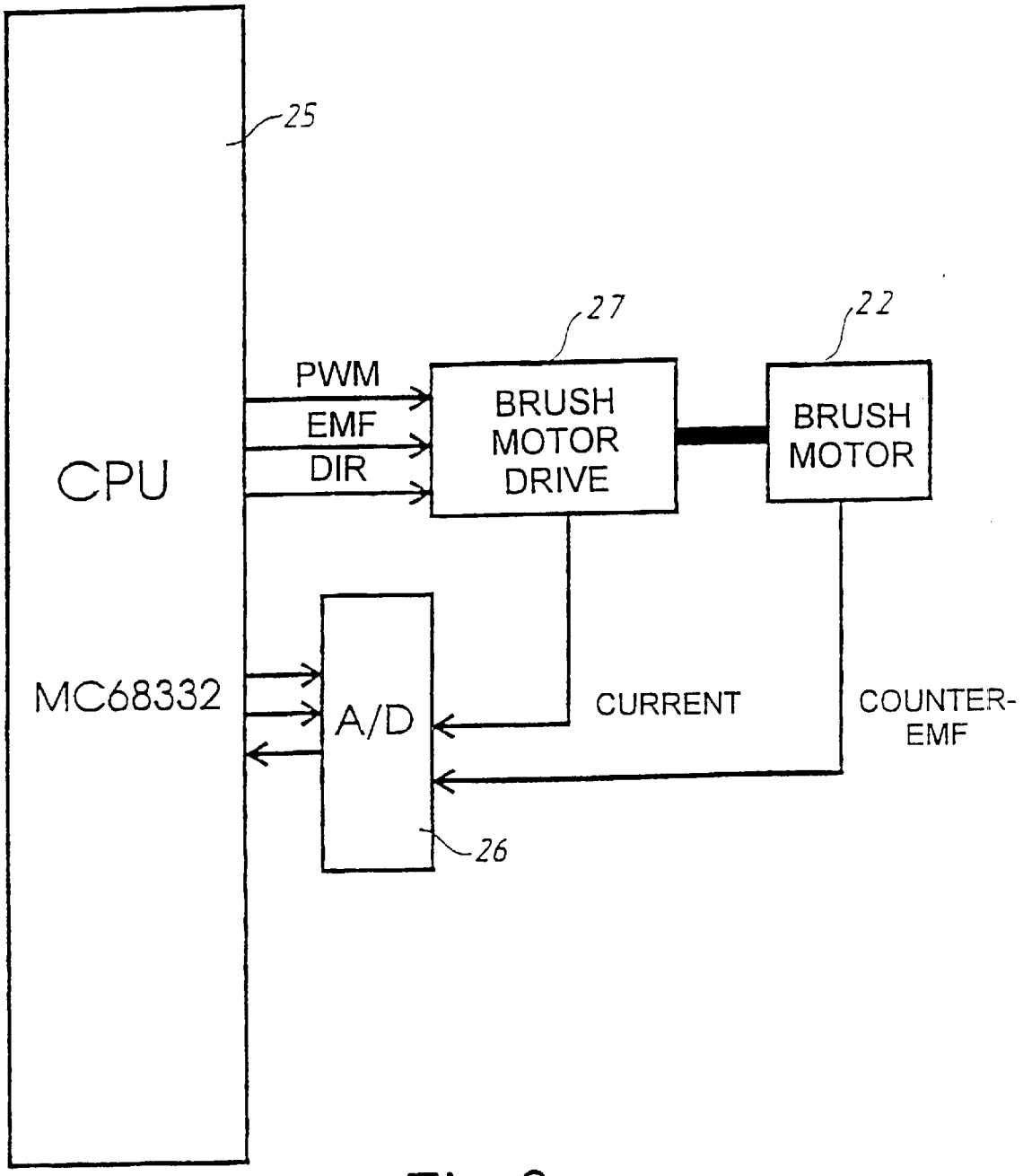
FIG. 3 shows a block diagram of the components constituting the brush roller motor drive.

In FIG. 3 there is shown a block diagram over the driving of the brush roller motor 22. For the determination of if the brush roller motor has been blocked the current is measured in the drive circuits provided between the microprocessor 25 and the brush roller motor 22. The measurement value is converted into digital form in an A/D-converter 26.

Advantageously, the brush roller motor is driven at a speed below the maximum speed, e.g. at half the maximum speed. Because the device is to operate on a base with varying friction conditions it is desirable to keep the speed at a mainly constant level. Such regulation means that if vacuuming takes place on a hard floor an increase of the speed of the brush roller, which otherwise would occur, is avoided. At the same time it is possible to avoid the brush roller losing speed, with the resulting reduction in dust collection, during vacuuming on a soft carpet where the brush motor has to work harder.

For the speed to be kept constant it is a prerequisite that it is possible to measure the speed in a simple manner, if not continuously, yet with high periodicity. The invention makes use of the sensing of the EMF generated by the DC motor 22 when its drive voltage is transitory disconnected. This EMF-value is fed to the A/D-converter 26 to be converted into digital form prior to being applied to an input of the microprocessor 25. For the control of the DC motor 22 to operate at the desired speed a signal PWM is sent to a drive circuit 27 which in turn is connected to the brush roller motor 22. A signal DIR is sent from the microprocessor 25 to the drive circuit 27 for the determination of the direction of rotation of the motor, forward or backward. A signal EMF is sent to the drive circuit 27 for initiating of EMF-measurement when the driving has been transitory disconnected. For said EMF-measurement the drive voltage is being disconnected for about 10 milliseconds with a periodicity of about 100 milliseconds.

What is claimed is:

1. An autonomous device (10) adapted to automatically move on a work surface (11) removing dirt, such as gravel, sand, dust particles and the like, from said work surface, said device (10) comprising a chassis (12) provided with wheels and with a brush roller (20) rotated by a brush roller motor (22) during said movement for the purpose of brushing up the dirt towards a suction duct (23) wherefrom, by means of a suction air stream, the dirt is conveyed to a dust container (24), an electronic control device (25) being provided for the control of the drive motor (22) of the brush roller, characterized in that if the movement of the brush roller (20) is blocked or obstructed to a predetermined extent the control device (25) is arranged to stop the brush roller motor (22) and then transitorily activate the brush roller motor (22) in the opposite direction and, finally, to reconnect the brush roller motor (22) to operate in the original direction of rotation.

2. An autonomous device according to claim 1, characterized in that the control device (25) is arranged to measure, at a predetermined periodicity, the current through the brush roller motor (22) and to order backward drive of the brush roller motor if the motor current exceeds a predetermined limit.

3. An autonomous device according to claim 2, characterized in that the control device (25) is arranged to measure the motor current also during the backward drive and to stop the brush roller motor (22) if the motor current limit is exceeded.

4. An autonomous device according to claim 1, characterized in that the control device (25) is arranged to operate the brush roller motor (22) at a rated speed lower than the maximum speed and to keep the rated speed almost constant.

5. An autonomous device according to claim 4, characterized in that the brush roller motor (22) is a DC motor and the control device (25) is arranged to drive the brush roller motor (22) with a voltage that is pulse-width modulated.

6. An autonomous device according to claim 5, characterized in that the control device (25) is arranged to transitorily, at a predetermined periodicity, disconnect the drive voltage, the control device (25) having an input on which the EMF generated by the motor (22) during the corresponding time slot is applied for the determination of the speed of the motor.

7. An autonomous device according to any of the preceding claims, characterized in that the normal direction of rotation of the brush roller (20) is opposite to that of the drive wheels (14, 15) of the device when the device (10) is moving on the work surface (11) and cleaning takes place.

8. An autonomous device according to claim 1, characterized in that the electronic control device (25) is a microcomputer.

* * * * *

UNITED STATES PATENT AND TRADEMARK OFFICE

CERTIFICATE OF CORRECTION

PATENT NO. : 5,940,927

DATED : August 24, 1999

INVENTOR(S) : Haegermarck et al.

It is certified that error appears in the above-identified patent and that said Letters Patent is hereby corrected as shown below:

Claim 7, Column 4, Lines 56-57, delete "any of the preceeding claims" and insert --claim 1--.

Signed and Sealed this

Twenty-eighth Day of December, 1999

*Attest:*

Q. TODD DICKINSON

*Attesting Officer*

*Acting Commissioner of Patents and Trademarks*